United States Patent [19]

Mammino et al.

[11] 4,078,930

[45] Mar. 14, 1978

[54] DEVELOPER COMPOSITIONS COMPRISING TONER AND CARRIER

[75] Inventors: Joseph Mammino, Penfield; Franklin Jossel, Rochester, both of N.Y.

[73] Assignee: Xerox Corporation, Stamford, Conn.

[21] Appl. No.: 626,598

[22] Filed: Oct. 28, 1975

[51] Int. Cl.[2] ..... G03G 9/10

[52] U.S. Cl. ..... 96/1 SD; 252/62.1 P; 427/19

[58] Field of Search ..... 427/14, 19; 252/62.1; 96/1 SD

[56] References Cited

U.S. PATENT DOCUMENTS

| | | | |
|---|---|---|---|
| 3,607,342 | 9/1971 | Sato | 252/62.1 X |
| 3,838,054 | 9/1974 | Trachtenberg et al. | 252/62.1 |

OTHER PUBLICATIONS

*Journal of Polymer Science;* "Static Electricity in Polymers I. Theory and Measurement"; Victor E. Shashoua, vol. 33; pp. 65–66, (1958).

*Primary Examiner*—Ronald H. Smith
*Assistant Examiner*—Stuart D. Frenkel

[57] ABSTRACT

Novel developers in which the toner and carrier or toner and a carrier coating comprise substantially the same composition. Methods of using the novel developers are also disclosed.

32 Claims, No Drawings

DEVELOPER COMPOSITIONS COMPRISING TONER AND CARRIER

BACKGROUND OF THE INVENTION

This invention relates to electrophotography and more particularly to improved electrostatographic developing materials, their manufacture and use.

The formation and development of images on the surface of photoconductor materials by electrostatic means is well known. The basic xerographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting latent electrostatic image by depositing on the image a finely-divided electroscopic material referred to in the art as "toner." The toner will normally be attracted to those areas of the layer which retain a charge, thereby forming a toner image corresponding to the latent electrostatic image. This powder image may then be transferred to a support surface such as paper. The transferred image may subsequently be permanently affixed to the support surface as by heat. Instead of latent image formation by uniformly charging the photoconductive layer and then exposing the layer to a ligh-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps.

Several methods are known for applying the electroscopic particles to the latent electrostatic image to be developed. One development method, as disclosed by E. N. Wise in U.S. Pat. No. 2,618,552, is known as "cascade" development. In this method, a developer material comprising relatively large carrier particles having finely-divided toner particles electrostatically coated thereon is conveyed to and rolled or cascaded across the electrostatic latent image bearing surface. The composition of the carrier particles is so selected as to triboelectrically charge the toner particles to the desired polarity. As the mixture cascades or rolls across the image bearing surface, the toner particles are electrostatically deposited and secured to the charged portion of the latent image and are not deposited on the uncharged or background portions of the image. Most of the toner particles accidentally deposited in the background are removed by the rolling carrier, due apparently, to the greater electrostatic attraction between the toner and the carrier than between the toner and the discharged background. The carrier and excess toner are then recycled. This technique is extremely good for the development of line copy images.

Another method of developing electrostatic images is the "magnetic brush" process as disclosed, for example, in U.S. Pat. No. 2,874,063. In this method, a developer material containing toner and magnetic carrier particles are carried by a magnet. The magnetic field of the magnet causes alignment of the magnetic carrier into a brush-like configuration. This "magnetic brush" is engaged with the electrostatic image-bearing surface and the toner particles are drawn from the brush to the latent image by electrostatic attraction.

Still another technique for developing electrostatic latent images is the "powder cloud" process as disclosed, for example, by C. F. Carlson in U.S. Pat. No. 2,221,776. In this method, a developer material comprising electrically charged toner particles in a gaseous fluid is passed adjacent the surface bearing the latent electrostatic image. The toner particles are drawn by electrostatic attraction from the gas to the latent image. This process is particularly useful in continuous tone development.

Other development methods such as "touchdown" development, as disclosed by R. W. Gundlach in U.S. Pat. No. 3,166,432, may be used where suitable.

It is apparent that in development techniques requiring a carrier that the carrier and toner must have suitable triboelectric potential in order to properly develop the electrostatic image. The toner material for use in an electrophotographic process must be capable of accepting a charge of correct polarity when brought into rubbing contact with the surface of a carrier material, in cascade, magnetic brush or touchdown development systems. For that reason, the carrier and toner material were selected such that their triboelectric properties were different resulting in the generation of the desired charge on the toner material to enable the development of the electrostatic image.

More particularly, the toner and carrier are separated from each other in the triboelectric series, an artificial framework that positions substances according to their electrochemical potentials. Determining the triboelectric series position of a material is accomplished merely by contacting two materials, separating them and detecting the charge polarity of each with an electrometer or other suitable charge recording instrument. The series is then conventionally complied in descending order from positive to negative such that a material higher in the series charges positively with respect to those lower in the series. Although any member of the triboelectric series is itself electrically neutral, when two members (their surfaces differing in electrochemical potential) are placed in intimate contact, an imbalance in surface potential is created at their contact interface and electrons will tend to flow from the member having a lower energy level, thereby seeking to equalize the noted surface potential imbalance. When the members are separated or removed from intimate contact, the charge transfer that has occurred between such members to equalize their varying surface potentials is not given sufficient time to reverse itself and thereby retain the original electrical neutrality of each member. The net effect is an electrical surface charge present on each member, the charges being of equal magnitude but of opposite polarity. The member that is higher in the triboelectric series will have a positive polarity charge. Some resinous materials which possess many suitable properties such as fusing, transparency, adhesion, etc. for use in toners were unable to be used due to undesirable electronic properties which do not enable their use in conventional toner materials.

SUMMARY OF THE INVENTION

It is, therefore, an object of this invention to provide a developer overcoming the above-noted deficiencies.

It is a further object of this invention to provide a developer which forms high resolution images.

It is another object of this invention to provide a developer which is easy to form.

It is yet a further object of this invention to provide a developer with less impaction problems.

It is another object of this invention to provide a developer which forms images having reduced background.

It is a further object of this invention to provide a developer with desirable electronic properties.

It is an additional object of this invention to provide a novel developer composition.

It is yet an additional object of this invention to provide a novel method of imaging.

The above objects and others are accomplished by providing an electrophotographic developer comprising a toner and carrier having the same composition. A carrier may be a large particle of the same material as the toner or it may be a particle with a core material overcoated with the composition which is the same as the toner composition. This is a very surprising discovery as it is contrary to what has been classical electrophotographic development practice and theory. The method by which charges are generated in order to enable toners and carriers of the same composition to operate in the customary manner in electrophotographic copying is not completely understood. However, it is theorized that the difference in size of the particles accounts for the generation of a different charge between the small toner particle and the large carrier particle.

The problem of impaction which is the coating of the carrier with toner fines resulting in a change in triboelectric properties is virtually eliminated by the invention as the impaction of toner fines on the surface of a carrier of the same composition has substantially no adverse effect.

DESCRIPTION OF THE PREFERRED EMBODIMENTS

Developers of this invention encompass those in which the composition of the toner and carrier or carrier coating is identically the same or substantially the same. Compositions which are substantially the same include those in which the resin is the same but the colorant content may differ by a slight and unsubstantial amount between the toner and carrier. Substantially the same compositions also would include those which differ by the addition of small amounts of inert materials which do not affect triboelectric properties. Substantially the same compositions also include those instances in which the polymer in the toner and carrier has been oriented to different degrees during formation into the toner and carriers. Substantially the same compositions are also those in which the colorant is of identical composition in both toner and carrier but of a different crystalline polymorphic form or where the same colorant may exist as either a pigment or a dye depending on the solvent used in the formation of the coating and toner. The colorant may be dispersed as a dye in molecular size or be present in discrete pigment size particles depending on the solvent which is used. Substantially the same also includes instances where the compositions are the same, but where forming processes have caused slight stratification of the colorant, filler or other material in the composition forming the carrier and toner.

Any suitable resin may be used as the polymer which forms the toner particle and the carrier coating or homogenous carrier particle. In the case of coated carrier material, the core particle onto which the composition which forms the toner is coated may be formed of any suitable compositions. Typical carrier materials include sodium chloride, ammonium chloride, aluminum potassium chloride, Rochelle salt, sodium nitrate, aluminum nitrate, potassium chloride, granular zircon, granular silicon, methylmethacrylate, glass, steel, nickel, iron, ferrites, ferromagnetic materials, silicon dioxide and the like. The preferred carrier core materials for the instant invention are nickel and steel particles. The nickel carriers may be a member of the group of nodular carrier beads disclosed in U.S. Pat. Nos. 3,847,604 and 3,767,568, characterized by a nodular surface with reoccurring fissures giving the particles a relatively large external surface area and composed of nickel. These are commonly called nickel berry carriers. These preferred carrier core materials have been found to give desirable coating properties.

Any suitable resin may be employed in the toners and carriers of the present system including homopolymers or copolymers of two or more vinyl monomers. Typical such vinyl monomeric units include: sytrene; p-chlorostyrene; vinyl naphthalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl esters such as vinyl metyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrole, N-vinyl carbazole, N-vinyl indole, N-vinyl pyrrolidene and the like; and mixtures thereof.

Among typical styrenes, it is generally found that toner and carrier resins containing a relatively high percentage of styrene are preferred since greater image definition and density is obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic and cationic polymerization processes. Any of these vinyl resins may be blended with one or more other resins if desired, preferably other vinyl resins which insure good triboelectric stability and uniform resistance against physical degradation. However, non-vinyl type thermoplastic resins may also be employed on toners and carriers including rosin, phenol formaldehyde resins, oil modified epoxy resins, polyurethane resins, cellulosic resins, polyether resins, polycarbonates, polysulfones, polyphenylene oxides, silicone and fluorocarbon resins and mixtures thereof.

Polymeric esterification products of a dicarboxylic acid and a diol comprising a diphenol may also be used as the resin material for the toner and carrier compositions of the instant invention. The diphenol reactant has the general formula:

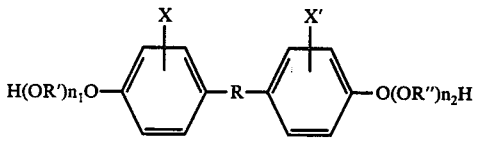

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R' and R" represent substituted and unsubstituted alkylene radicals having from 2 to 12 carbon atoms, alkylene arylene radicals having from 8 to 12 carbon atoms, and arylene radicals; X and X' represent hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms are preferred because greater blocking resistance, increased definition of xerographic characters and more complete transfer of toner images are achieved. Optimum results among typical diols are obtained with diols in which R' is an isopropylidene radical and R' and R" are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred, because the resulting toner resin possesses greater resistance to film formation on reusable imaging surfaces and resist the formation of fines under machine operation conditions. Optimum results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such dipenols include: 2,2-bis(4-beta hydroxyl ethoxy phenyl)-propane, 2,2-bis(4-hydroxy isopropoxy phenyl) propane, 2,2-bis(4-beta hydroxy ethoxy phenyl) pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl) propane, 1,1-bis(4-hydroxyl-ethoxy-phenyl)-butane, 1,1-bis(4-hydroxyl isopropoxy-phenyl) heptane, 2,2-bis(3-methyl-4-beta-hydroxy ethoxy-phenyl) propane, 1,1-bis(4-beta hydroxy ethoxy phenyl)-cyclohexane, 2,2'-bis(4-beta hydroxy ethoxy phenyl)-norbornane, 2,2'bis(4-beta hydroxy ethoxy phenyl) norbornane, 2,2-bis(4-beta hydroxy styryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R' and R" represent an alkylene radical having from 3 to 4 carbon atoms are preferred because greater blocking resistance, increased definition of xerographic characters and more complete transfer of toner images are achieved. Optimum results are obtained with diols in which R is isopropylidene and R' and R" are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner and carrier compositions of this invention either substituted or unsubstituted, saturated or unsaturated, having the general formula:

$$HOOC\ R'''^{3}_{n}\ COOH$$

wherein R''' represents a substituted or unsubstituted alkylene radical having from 1 to 12 carbon atoms, arylene radicals or alkylene radicals having from 10 to 12 carbon atoms and $n_3$ is less than 2. Typical such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on reusable imaging surfaces and resist the formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: rosin, phenol formaldehyde resins, oil modified epoxy resins, polycarbonate, polysulfone, polyphenylene oxide, polyurethane resins, cellulosic resins, vinyl type resins and mixtures thereof. When the resin component of the toner and carrier contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique such as hot melt, solvent, and emulsion techniques may be employed to incorporate the added resin into the toner mixture. The resulting resin blend is substantially homogeneous and highly compatible with pigments and dyes. Where suitable, the colorant may be added prior to simultaneously with or subsequent to the blending or polymerization step.

Suitable polymers for use in the toner, homogeneous carrier and carrier coating of the invention are the copolymers of styrene with esters of alphamethylene aliphatic monocarboxylic acids. The preferred copolymer is styrene-n-butylmethacrylate which has been found to give particularly desirable fusing and triboelectric properties.

Any suitable pigment or dye may be employed as the colorant for the polymers which form the toner and homogenous carrier or coatings for the carrier particle.

Toner colorants are well known and include those mentioned in the Colour Index, Third Edition, published by the Society of Dyers and Colourists, for example, carbon black, nigrosine dye, Aniline Blue, Calco Oil Blue, Chrome Yellow, Ultramarine blue, duPont Oil Red, Quinoline Yellow, methylene blue chloride, phthalocyanine blue, Malachite Green Oxalate, lampblack, Rose Bengal and mixtures thereof. The pigment or dyes should be present in the toner in a sufficient quantity to render it highly colored so that it will form a clear visible image on a recording member. Thus, for example, where conventional xerographic copies of typed documents are desired, the toner may comprise a black pigment such as carbon black or a black dye such as Amaplast Black dye, available from the National Aniline Products Inc. Preferably, the pigment is employed in an amount from about 3 percent to about 20 percent, by weight, based on the total weight of the colored toner. If the toner colorant employed is a dye, substantially small quantities of colorant may be used. Materials particularly suitable for the process of the invention have been found to be the cyan colorant octadecylamine sulfonamide substituted copper phthalocyanine, dimethyl substituted quinacridone pigment, diarylide yellow, C.I. Pigment 97, C.I. Solvent Red 24, C.I. Disperse Yellow 33, described in U.S. Pat. No. 3,844,815, and carbon black as these materials give particularly high colored images and good triboelectric properties.

The toner compositions of the present invention may be prepared by any well-known toner-mixing and comminution technique. For example, the ingredients may be thoroughly mixed by blending, mixing, milling or extruding the components and thereafter micropulverizing the resulting mixture. Another well-known technique for forming toner particles is to spray dry a ball-milled toner composition comprising a colorant, a resin and a solvent.

The carrier of the invention may be of any suitable size to give proper triboelectric properties with the selected toner particle size. The developer combinations of the invention may be utilized in developing both positive and negative electrostatic latent images and in both normal and reversal development. An ultimate coated or homogenous carrier particle diameter of between about 50 microns to about 1,000 microns is suitable. A preferred particle size is between about 75 and about 400 microns, because the carrier particles then present a sufficient density and inertia to avoid adherence to electrostatic images during the cascade development processes. Optimum performance with the toners of the instant invention is about 100 to about 200 microns for best density images and long life. The carrier may be employed with the toner composition in any suitable combination. Satisfactory results have been obtained when about 1 part toner is used to about 10 to about 200 parts by weight of carrier. A preferred combination is between about 1 to about 5 parts toner per 100 parts carrier to give sharp images with low background. The toner particles of this invention may be any suitable size which when combined with the selected carrier will give desirable triboelectric properties. Toners of the invention suitable for use with the carrier in cascade and magnetic development generally have an average particle size of about 5 microns to about 45 microns. A preferred average particle size range is about 8 microns to about 20 microns to result in a print of maximum density and ease of fusing.

The electrostatic latent image as developed by the toner compositions of the instant invention may reside on any surface capable of retaining charge. In electrophotographic applications a photoconductive member is employed to form the electrostatic latent image. The photoconductive layer may comprise an inorganic or organic photoconductive material. Typical inorganic materials include sulfur, selenium, zinc sulfide, zinc oxide and cadmium selenide. Typical organic photoconductors include: triphenylamine; 2,4-bis(4,4'-diethylamino-phenol)-1,3,4-oxidiazol; N-isopropylcarbazole; triphenylpyrrol; 4,5-diphenylimidazolidone; 4,5-diphenylimidazolidinethione; 4,5-bis(4'-aminophenyl)-imidazolidinone; 1,5-dicyanonaphthalene; 1,4-dicyanonaphthalene; aminophthalodinitrile; nitrophthalodinitrile; 1,2,5,6-tetraazacyclooctatetraene-(2,4,6,8); 2-mercaptobenzothiazole-2-phenyl-4-diphenylidene-oxazolone; 6-hydroxy-2,3-di(p-methoxyphenyl)-benzofurane; 4-dimethylamino-benzylidene-benzhydrazide; 3,benzylidene-amino-carbazole; polyvinyl carbazole; (2-nitro-benzylidene)-p-bromo-aniline; 2,4-diphenyl-quinazoline; 1,2,4-triazine; 1,5-diphenyl-3-methyl-pyrazoline 2-(4'-dimethyl-amino phenyl)-benzoxazole; 3-amino-carbazole; polyvinylcarbazole-trinitro-fluorenone charge transfer complex; phthalocyanines and mixtures thereof.

The following Examples futher define, describe and compare methods of forming and using the preferred, novel developers of the invention. Parts and percentages are by weight unless otherwise indicated.

EXAMPLE I

A cyan xerographic developer is prepared by taking extruded 65/35 styrene-n-butylmethacrylate copolymer pellets about 1/16 inch long to about ⅛ inch long by about ⅛ inch diameter composed of about 5 percent by weight of Heliogen Blue OS (available from GAF) a copper tetra-4-(octadecylsulfonomido) phthalocyanine dye pigment uniformly dispersed in the styrene-n-butylmethacrylate polymer as the carrier component and the same composition ground to about 15 micron size as the toner component. Roll-mill total blow-off tribo measurements are made which show that the toner acquires a negative charge of sufficient magnitude to be utilized as a xerographic cascade developer. The tribo of the toner after 10 minutes was about $-5$ $\mu c/g$ and after 1 hour $-3.3$ $\mu c/g$. In this and the following examples, triboelectric values are measured by means of a Faraday Cage such as described at column 11, lines 5–28 of U.S. Pat. No. 3,533,835.

EXAMPLE II

A magenta developer is prepared by taking 65/35 styrene-n-butylmethacrylate copolymer pellets composed of 5 percent by weight of a 2,9-dimethylquinacridone pigment uniformly dispersed in the styrene-n-butylmethacrylate resin as the carrier component and the same composition ground to about 15 micron size as the toner component. The carrier component has a size of approximately ⅛ inch diameter. Roll-mill tribo measurements were made which showed that the toner acquires a negative charge.

| | Tribo μc/g | | |
|---|---|---|---|
| | 10 min. | 30 min. | 3 hr. |
| Developer carrier pellets/toner | −5.8 | −8.6 | −5.4 |

The developer is used to develop a positive charged and light-exposed selenium plate by the cascade development technique using a Xerox flat plate machine. The negative charged particles adhere to the positive latent image on the selenium plate to yield a positive image sense print. The image is electrostatically transferred to paper and heat-fused. The print produced is clean with sharp definition and free of background toner deposits. The selenium plate is cleaned of residual toner and the developer reused to generate several more images.

EXAMPLE III

A yellow developer is prepared as described in Example I using 65/35 styrene-n-butylmethacrylate pellets composed of about 5 percent by weight diarylide yellow pigment from duPont classified in the Colour Index as Pigment Yellow 12, C.I. 21090 uniformly dispersed in styrene-n-butylmethacrylate resin as the carrier and as the toner. Particle sizes are as in Example I. Roll mill, total blow-off tribo measurements show that the toner acquires a negative charge.

| | Tribo | |
|---|---|---|
| | 10 min | 1 hr |
| Developer carrier pellets/toner | −0.95 | −0.40 |

EXAMPLE IV

In this example a magnetic nickel berry core material about 100 microns size is coated with a magenta composition, the composition also serves as the toner. Three magenta coated carrier compositions are prepared by taking weight amounts of the Example II toner together with nickel berry core material and jar roll milling the mixture to uniformly coat the nickel surface with toner. The mixture is placed in a heated oven (250° F) for ½ hr. to result in a carrier which is throughly surface coated with magenta toner composition. The mixture is sieved to remove coarse particles. The carriers prepared are:

| | wt. amt. coating | wt. amt. carrier core g | mg coating g carrier | % coating wt. |
|---|---|---|---|---|
| 4A | 0.9 | 600 | .0015 | .15 |
| 4B | 1-8 | 600 | .0030 | .30 |
| 4C | 3-6 | 600 | .0060 | .60 |
| 4D | 0 | 600 | 0 | 0 |

Each carrier above is combined with the Example II toner to form a xerographic developer containing 4% toner concentration. Roll mill, total blow-off measurements are made which show that the developers prepared in which the toner and carrier coating in contact charging configuration are the same material all perform equally well compared to developer 4D in which the contacting materials are different. This example surprisingly shows that coating does not significantly affect the tribo properties.

| | Tribo μc/g (% by weight) (toner concentration) | | | | |
|---|---|---|---|---|---|
| Sample Developer | 10 min. | 30 min. | 3 hr. | 26 hr. | 50 hr. |
| 4A | 5.2 (3.9) | 6.3 (3.9) | 8.9 (3.7) | 12.2 (3.6) | 11.5 (3.8) |
| 4B | 4.5 (3.8) | 6.1 (3.7) | 8.6 (3.9) | 9.5 (3.8) | 9.6 (3.9) |
| 4C | 4.1 (3.8) | 5.8 (3.8) | 8.6 (3.9) | 10.8 (3.7) | 9.3 (3.7) |
| 4D | 5.3 (3.7) | 6.8 (3.8) | 9.6 (3.8) | 10.5 (3.6) | 9.3 (3.7) |

EXAMPLE V

The carrier coating composition described in Example IV above is prepared by dissolving the toner in a solvent, adding 100 microns nickel berry core to the polymer-pigment solvent mixture and while the mixture is stirred by suitable means, heat was applied to evaporate the solvent. The resultant is a carrier thoroughly coated on the surface with toner composition. The coated carrier is combined with a toner of the same chemical composition as the coating, except of 10 microns size. Tribo measurements, as below, and magnetic brush developed prints are made. The prints are of satisfactory sharpness.

| | Toner Concentration % By Weight | Tribo μc/g |
|---|---|---|
| After 10 min. | 1.93 | 8.57 |
| After 6 prints | 1.30 | 9.45 |

EXAMPLE VI

A polymer composition of 65/35 styrene-n-butylmethacrylate with polyvinyl butyral and 10 parts carbon black is fritted to a particle size of about 1/16 inch and employed as carrier and combined with 1% toner of the same composition of about 15 μ particle size. Tribo measurements are made which indicate that the toner acquires a positive charge of low magnitude and should develop reversal image sense images when employed as described in Example II above to produce images. The tribo was 0.3 μc/g after 10 min. and 0.6 μc/g after 1 hr.

Surprisingly, this developer performs as an ambipolar developer, i.e. both a positive or a negative image sense print can be produced depending on the charge polarity used for electrostatic transfer.

EXAMPLE VII

A magenta xerographic developer is prepared by formation of a 2% mixture of styrene-n-butylmethacrylate copolymer with 2,9-dimethylquinacridone pigment identified in the Colour Index as Pigment Red 122 available from American Hoechst Corp. under the designation Hostaperm Pink E. This mixture is coated on a steel carrier of about 100 microns. The percent coating weight on the steel particle is about 0.3. The toner particle size is about 15 microns. This material is tested in a conventional Xerox 6500 machine and tribo measurements were taken over a period of 25,000 copies. The results are indicated below and demonstrate that the magenta toner when combined with magenta toner coated steel gives desirable triboelectric properties.

| Copy Count (K) | Toner Conc. % | Tribo μc/g | Tribo* Product | Humidity % | Temp. ° |
|---|---|---|---|---|---|
| Bottle Sample | 2.04 | 4.72 | 9.63 | | |

-continued

| Copy Count (K) | Toner Conc. % | Tribo μc/g | Tribo* Product | Humidity % | Temp. ° |
|---|---|---|---|---|---|
| .5 | 3.26 | 7.92 | 25.82 | | |
| 1.0 | 3.73 | 7.64 | 28.50 | | |
| 1.5 | 3.60 | 7.95 | 28.62 | | |
| 2.0 | 3.79 | 7.84 | 29.71 | | |
| 2.5 | 3.40 | 8.67 | 29.48 | | |
| 3.0 | 3.46 | 8.44 | 29.20 | | |
| 3.5 | 3.44 | 8.58 | 29.52 | | |
| 4.0 | 3.57 | 8.87 | 31.67 | | |
| 4.5 | 3.67 | 8.23 | 30.20 | | |
| 5.0 | 3.61 | 8.23 | 29.60 | | |
| 6.0 | 3.12 | 8.20 | 29.60 | | |
| 7.0 | 2.67 | 9.43 | 25.18 | | |
| 8.0 | 2.77 | 9.50 | 26.31 | | |
| 9.0 | 2.34 | 11.95 | 27.96 | | |
| 10.0 | | | | | |
| 11.0 | 2.13 | 10.00 | 21.30 | 18 | 73 |
| 12.0 | 2.27 | 10.23 | 23.05 | | |
| 13.0 | 2.23 | 10.00 | 22.30 | | |
| 14.0 | 2.31 | 10.00 | 23.10 | 25 | 73 |
| 15.0 | 2.22 | 9.74 | 21.62 | 25 | 73 |
| 16.0 | 2.07 | 9.74 | 20.37 | 23 | 73 |
| 17.0 | | | | | |
| 18.0 | | | | | |
| 19.0 | | | | | |
| 20.0 | 1.75 | 9.03 | 15.80 | | |
| 21.0 | 1.30 | 10.22 | 13.29 | | |
| 22.0 | 1.57 | 8.57 | 13.45 | 32 | 73 |
| 23.0 | | | | | |
| 24.0 | 1.48 | 8.52 | 12.61 | | |
| 25.0 | 1.11 | 10.71 | 11.89 | | |

*Tribo Product is Toner Concentration × Tribo and represents a figure of merit.

EXAMPLE VIII

A magenta toner of about 15 micron particle size is formed as in Example II and coated with about 0.3 weight percent on a nickel berry carrier of a particle size of about 100 microns. A developer is formed by combining about 100 g magenta toner of the same composition and about 2,500 g of the carrier to form about a 3.8% developer. The developer is tested in a modified Xerox 720 and the following tribo properties are found.

| | Toner Concentration % | Tribo μc/g |
|---|---|---|
| 10 min. | 3.76 | 3.2 |
| Initial Prints | 2.87 | 6.2 |
| 1,000 | 2.11 | 20.1 |
| 2,000 | 4.59 | 11.8 |
| 3,000 | 4.47 | 11.0 |
| 4,000 | 3.78 | 13.5 |
| 5,000 | 3.00 | 15.8 |

EXAMPLE IX

A cyan toner of about 15 microns particle size is formed as in Example I and coated to about 0.6 weight percent on steel carrier of a particle size of about 100 microns. A developer is formed by combining about 66 g of cyan toner of the same composition and about 2200 g of the coated carrier to form about a 3% developer. The developer is tested in a modified Xerox 720 and the following tribo properties are found:

| Print No. | Toner Concentration % | Tribo μc/g |
|---|---|---|
| 10 min. - Roll Mill | 3.1 | 4.4 |
| Initial Prints | 3.4 | 9.1 |
| 1,000 | 3.0 | 12.5 |
| 2,000 | 3.0 | 9.8 |
| 3,000 | 3.6 | 8.8 |
| 4,000 | 4.4 | 6.3 |
| 5,000 | 3.3 | 10.2 |

EXAMPLE X

A yellow developer is prepared as described in Example I using 65/35 styrene-n-butylmethacrylate resin composed of about 5 percent by weight of Colour Index Pigment Yellow 97 available from American Hoechst Corp. as Permanent Yellow FGL as the toner. This toner composition is coated on a steel carrier of about 100 microns. The percent coating weight on the coated steel particle is about 0.6. The toner particle size is about 15 microns. Roll mill tribo measurements are made which indicate the toner acquires a negative charge.

| Tribo μc/g (Toner Concentration % By Weight) | | |
|---|---|---|
| 10 minutes | 30 minutes | 180 minutes |
| −4.8 (1.8) | −7.7 (2.0) | −10.3 (1.9) |

This developer is used to develop a positive charged selenium photoreceptor as described in Example II. The print produced is clean with sharp definition and free of background deposits. Several images are produced of this quality.

EXAMPLE XI

A red developer is prepared as described in Example I using 65/35 styrene-n-butylmethacrylate copolymer pellets composed of about 1.25 percent by weight of C.I. Solvent Red 24 dye available from American Cyanamid Co. under the designation of Calco Oil Red DM as the carrier component and the same composition ground to about 15 microns size as the toner component. The carrier is of approximately ⅛ inch diameter. Roll mill tribo measurements were made which showed the toner acquires a negative charge.

| | Tribo μc/g | |
|---|---|---|
| | 10 minutes | 30 minutes |
| Developer carrier pellets/toner | −1.5 | −2.2 |

EXAMPLE XII

A yellow toner of about 15 microns particle size is formed by spray drying a 5 percent by weight mixture of C.I. Disperse Yellow 33 dye in 65/35 styrene-n-butylmethacrylate copolymer resin from a methyl ethyl ketone solvent. The colorant is dissolved in the copolymeric resin. This toner composition is coated on a steel core of about 100 microns from a chloroform solvent as described in Example V. The percent coating weight on the steel particle is about 0.4. The colorant dispersed in the carrier coating exists as pigment particles as revealed by microscopic examination. The coated carrier is combined with the toner of the same composition and employed to produce several electrophotographic prints of satisfactory quality using Xerox Model D flat plate equipment.

EXAMPLE XIII

A cyan toner of about 15 microns particle size is formed composed of the beta form of metal-free phthalocyanine pigment dispersed in 65/35 styrene-n-butylmethacrylate copolymer resin 5 percent concentration by weight. A steel core of about 100 microns particle size is coated with the x-form of the same metal-free phthalocyanine pigment dispersed in 65/35 styrene-n-butylmethacrylate copolymer resin at 5 percent concentration by weight. Both crystal forms of the pigment are prepared from Monalite Fast Blue GS available from Aarold Hoffman Co. as described in U.S. Pat. No. 3,357,989. The coated carrier is combined with the toner of the same composition and employed to produce several electrophotographic prints of good quality using Xerox Model D flat plate equipment.

Although the present examples were specific in terms of conditions and materials used, any of the above listed typical materials may be substituted when suitable in the above examples with similar results. In addition to the steps used to carry out the process of the present invention, other steps or modifications may be used if desirable. For instance, magnetic particles could be added to the polymeric composition forming the toner and carrier to allow use in magnetic development systems. In addition, other materials may be incorporated in the system of the present invention which will enhance, synergize, or otherwise desirably affect the properties of the systems for their present use.

Anyone skilled in the art will have other modifications occur to him based on the teachings of the present invention. These modifications are intended to be encompassed within the scope of this invention.

What is claimed is:

1. A developer comprising toner particles and carrier particles wherein said toner and said carrier consist of substantially the same composition, said toner has a particle size between about 5 and about 45 microns, said carrier has a particle size between about 50 and about 1000 microns and said toner and said carrier are employed in a ratio of about 1 part toner to about 10 to about 200 parts by weight carrier.

2. The developer of claim 1 wherein said composition comprises a polymeric material and a colorant.

3. The developer of claim 1 wherein said composition of said carrier and toner is identically the same.

4. The developer of claim 1 wherein said toner has a particle size between about 8 and about 20 microns.

5. The developer of claim 2 wherein said polymeric material comprises styrene-n-butylmethacrylate.

6. The developer of claim 2 wherein said colorant is selected from the group consisting of copper tetra-4-(octadecylsulfonomido) phthalocyanine, carbon black, 2,9-dimethylquinacridone, Pigment Yellow 12 (C.I. 21090), C.I. Pigment Yellow 97, C.I. Solvent Red 24, C.I. Disperse Yellow 33 and C.I. Solvent Yellow 29.

7. The developer of claim 2 wherein said colorant is in a different crystalline polymorphic state in the toner than in the carrier.

8. The developer of claim 2 wherein said colorant is present as either a pigment or a dye.

9. A developer comprising toner particles and carrier particles, said toner has a particle size between about 5 and about 45 microns, said carrier has a particle size between about 50 and about 1000 microns, said toner and said carrier are employed in a ratio of about 1 part toner to about 10 to about 200 parts by weight carrier, said carrier comprises core particles surrounded by a coating and said toner and said coating consist of substantially the same composition.

10. The developer of claim 9 wherein said composition comprises a polymeric material and a colorant.

11. The developer of claim 9 wherein said toner has a particle size between about 8 and about 20 microns.

12. The developer of claim 10 wherein said polymeric material comprises styrene-n-butylmethacrylate.

13. The developer of claim 10 wherein said colorant is selected from the group consisting of copper tetra-4-(octadecylsulfonomido) phthalocyanine, carbon black, 2,9-dimethylquinacridone, Pigment Yellow 12 (C.I. 21090), C.I. Pigment Yellow 27, C.I. Solvent Red 24, C.I. Disperse Yellow 33 and C.I. Solvent Yellow 29.

14. The developer of claim 10 wherein said colorant is in a different crystalline polymorphic state in the toner than in the carrier.

15. The developer of claim 10 wherein said colorant is present as either a pigment or a dye.

16. An electrostatographic imaging process comprising establishing an electrostatic latent image on a surface and contacting said surface with a developer comprising toner particles and carrier particles, said toner has a particle size between about 5 and about 45 microns, said carrier has a particle size between about 50 and about 1000 microns, said toner and said carrier are employed in a ratio of about 1 part toner to about 10 to about 200 parts by weight carrier and said toner and said carrier consist of substantially the same composition.

17. The process of claim 16 wherein said composition comprises a polymeric material and a colorant.

18. The process of claim 16 wherein said toner has a particle size between about 8 and about 20 microns.

19. The process of claim 17 wherein said polymeric material comprises styrene-n-butylmethacrylate.

20. The process of claim 17 wherein said colorant is selected from the group consisting of copper tetra-4-(octadecylsulfonomido) phthalocyanine, carbon black, 2,9-dimethylquinacridone, Pigment Yellow 12 (C.I. 21090), C.I. Pigment Yellow 97, C.I. Solvent Red 24, C.I. Disperse Yellow 33 and C.I. Solvent Yellow 29.

21. The process of claim 17 wherein said colorant is in a different crystalline polymorphic form in the toner than in the carrier.

22. The process of claim 17 wherein said colorant is present as either a pigment or a dye.

23. An electrostatographic imaging process comprising establishing an electrostatic latent image on a surface and contacting said surface with a developer comprising toner particles and carrier particles, said toner has a particle size between about 5 and about 45 microns, said carrier has a particle size between about 50 and about 1000 microns, said toner and said carrier are employed in a ratio of about 1 part toner to about 10 to about 200 parts by weight carrier, said carrier comprises core particles surrounded by a coating and said toner and said coating consist of substantially the same composition.

24. The process of claim 23 wherein said composition comprises a polymeric material and a colorant.

25. The process of claim 23 wherein said toner has a particle size between about 8 and about 20 microns.

26. The process of claim 24 wherein said polymeric material comprises styrene-n-butylmethacrylate.

27. The process of claim 24 wherein said colorant is selected from the group consisting of copper tetra-4-(octadecylsulfonomido) phthalocyanine, carbon black, 2,9-dimethylquinacridone, Pigment Yellow 12 (C.I. 21090), C.I. Pigment Yellow 97, C.I. Solvent Red 24, C.I. Disperse Yellow 33 and C.I. Solvent Yellow 29.

28. The process of claim 23 wherein said carrier coating and said toner are identically the same.

29. The process of claim 24 wherein said colorant is in a different crystalline polymorphic form in the toner than in the carrier.

30. The process of claim 24 wherein said colorant is present as either a pigment or a dye.

31. A developer comprising toner particles and carrier particles, said toner has a particle size between about 5 and about 45 microns, said carrier has a particle size between about 50 and about 1000 microns, said toner and said carrier are employed in a ratio of about 1 part toner to about 10 to about 200 parts by weight carrier and the composition of said toner and the composition of the surface of said carrier consists of substantially the same composition.

32. The developer of claim 31 wherein said composition comprises a polymeric material and a colorant.

* * * * *